US006933814B2

(12) United States Patent
Ciarcia et al.

(10) Patent No.: US 6,933,814 B2
(45) Date of Patent: Aug. 23, 2005

(54) PHASE-TO-PHASE ISOLATION OF CASSETTE TYPE CIRCUIT BREAKERS

(75) Inventors: Ronald Ciarcia, Bristol, CT (US); Luis Brignoni, Toa Baja, PR (US); Narender Macha, Hyderbad (IN); Anantharam Subramanian, Secunderabad (IN); Samuel Stephen Kim, Bristol, CT (US)

(73) Assignee: General Electric Company, Schenectady, NY (US)

( * ) Notice: Subject to any disclaimer, the term of this patent is extended or adjusted under 35 U.S.C. 154(b) by 161 days.

(21) Appl. No.: 10/436,637

(22) Filed: May 13, 2003

(65) Prior Publication Data

US 2004/0227598 A1 Nov. 18, 2004

(51) Int. Cl.[7] ..... H01H 3/00; H01H 9/20
(52) U.S. Cl. ..... 335/8; 335/6; 200/244
(58) Field of Search ..... 335/6–46, 202; 200/17 R, 244

(56) References Cited

U.S. PATENT DOCUMENTS 6,052,046 A * 4/2000 Ennis et al. ..... 335/202
6,218,919 B1 4/2001 Ciarcia et al. ..... 335/167
6,310,307 B1 * 10/2001 Ciarcia et al. ..... 200/244

* cited by examiner

*Primary Examiner*—Ramon M. Barrera
(74) *Attorney, Agent, or Firm*—Cantor Colburn LLP

(57) ABSTRACT

A molded case, cassette type circuit breaker for a multi-pole electrical distribution circuit includes a number of cassettes equal to the number of poles in the multi-pole electrical distribution circuit and a pin disposed through each cassette. The pin is formed from a dielectric material. The pin may be further disposed through a portion of an operating mechanism for aligning the cassettes and the operating mechanism. Each cassette may include a rotor, a pair of electrical contacts, and a contact arm supported in the cassette by the rotor. In this embodiment, the pin may be a cross pin that extends between each rotor. The dielectric material may include phenolic, melamine, silicone, epoxy, polyester, fiberglass and the like. Alternatively, the pin includes a steel bar coated with the dielectric material, where the dielectric material may include, for example, epoxy, silicon, Teflon, and the like. A pair of end caps may be disposed over end surfaces of the rotor. Pole spacing between adjacent cassettes may be about one inch or less while providing sufficient dielectric integrity to meet requirements of the UL 489 standard.

30 Claims, 6 Drawing Sheets

PHASE-TO-PHASE ISOLATION OF CASSETTE TYPE CIRCUIT BREAKERS

BACKGROUND OF THE INVENTION

The present invention relates to circuit breakers and, more particularly, to cassette molded case circuit breakers.

Circuit breakers are installed in electrical distribution circuits to provide protection against high currents produced by various overcurrent conditions such as short-circuits, ground faults, overloads, etc. Circuit breakers typically employ one or more pairs of electrical contacts, an operating mechanism mechanically coupled to at least one of the contacts, and a trip unit that senses current or other electrical condition in the electrical distribution circuit and unlatches the operating mechanism to separate the pairs of contacts upon sensing an overcurrent condition.

Molded case circuit breakers employ a molded, electrically insulative case in which the various components of the circuit breaker are housed. Cassette type molded case circuit breakers have a number of cassettes disposed in the molded case, with the number of cassettes being equal to the number of poles (phases of current) in a multi-pole electrical distribution circuit. Each cassette includes a molded, insulative housing in which the one or more pairs of electrical contacts for the pole are housed. One contact in each contact pair is mounted on a contact arm, which may be supported within the cassette by a rotor. The rotor is mechanically coupled to the operating mechanism, which acts on the rotor to pivot the contact arm within the cassette for opening and closing the contact pairs.

Underwriters Laboratory (UL) 489 standard, entitled "Molded-Case Circuit Breakers, Molded-Case Switches, and Circuit Breaker Enclosures", sets forth various tests for molded case circuit breakers. One such test requires that the circuit breaker pass a dielectric test after the breaker is subjected to seven short circuit tests in which the circuit breaker is expected to successfully clear the fault at the rated voltage of the circuit breaker. The seven short circuit tests cause the circuit breaker to become highly contaminated, internally, with electrically conductive carbon particles. A dielectric test is then conducted between poles of opposite polarity and ground at a voltage level of 1000 volts plus two times the rating of the breaker. For example, the dielectric test for a circuit breaker rated at 600 volts would be: 2(600 volts)+1000 volts=2200 volts. The circuit breaker must withstand this voltage for one minute without breakdown.

To ensure that a cassette type circuit breaker passes the UL 489 dielectric test, the spacing between the cassettes is increased and/or the wall thickness of the cassette housings are increased to provide an adequate amount of insulation and isolation (as specified in UL 489) between phases in the circuit breaker. However, the ability to increase the pole spacing and/or wall thickness of the cassette housing can conflict with the desire to provide a compact circuit breaker. That is, increasing the pole spacing and/or the wall thickness of the cassettes to improve the dielectric integrity of the circuit breaker will also require that the overall size of the circuit breaker be increased. It is, therefore, desired to provide a compact circuit breaker meeting the requirements of the UL 489 dielectric test.

BRIEF SUMMARY OF THE INVENTION

The above discussed and other drawbacks and deficiencies are overcome or alleviated by a molded case, cassette type circuit breaker for a multi-pole electrical distribution circuit. The circuit breaker includes a number of cassettes equal to the number of poles in the multi-pole electrical distribution circuit and a pin disposed through each cassette. The pin is formed from a dielectric material. In one embodiment, each cassette includes a rotor, a pair of electrical contacts, and a contact arm supported in the cassette by the rotor. The pin is a cross pin that extends between each rotor, the cross pin being formed from a dielectric material. In another embodiment, the pin further extends through a portion of an operating mechanism, the pin maintaining the operating mechanism and the cassettes in alignment. The pin may be formed from phenolic, melamine, silicone, epoxy, fiberglass and the like. Alternatively, the pin includes a steel bar coated with the dielectric material, where the dielectric material may include, for example, epoxy, silicon, Teflon, and the like. In one embodiment, a pair of end caps is disposed over end surfaces of the rotor. Pole spacing between adjacent cassettes may be about one inch or less.

In another aspect, a molded case, cassette type circuit breaker for a multi-pole electrical distribution circuit includes a number of cassettes equal to the number of poles in the multi-pole electrical distribution circuit, and the cassettes have a pole spacing of less than or equal to about one inch. In one embodiment, the pole spacing is less than or equal to about one inch and greater than or equal to about 0.6 inches. The circuit breaker may be rated at 150 amps or less and at one of 600 volts, 347/600 volts, 480 volts, and 277/480 volts, while meeting the dielectric requirements of the UL 489 standard.

BRIEF DESCRIPTION OF THE DRAWINGS

Referring to the drawings wherein like elements are numbered alike in the several Figures.

DETAILED DESCRIPTION OF THE INVENTION

Figure 1:
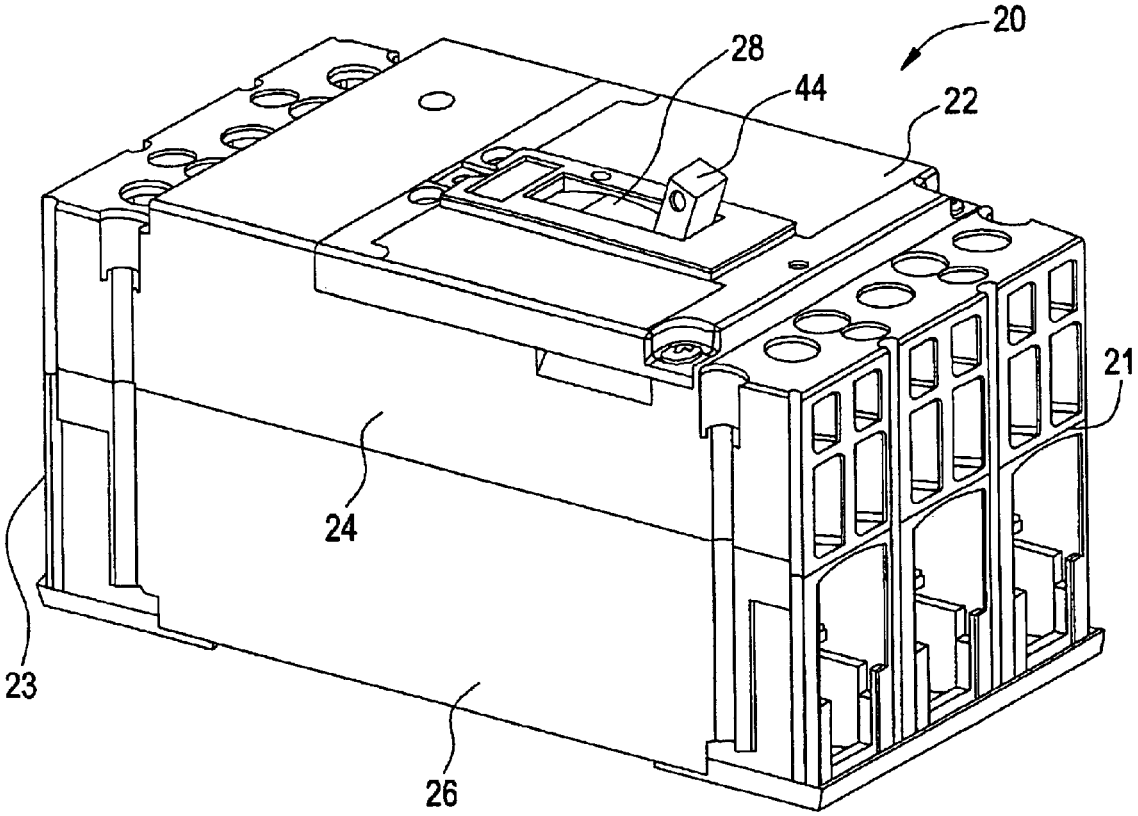
FIG. 1 is an isometric view of a molded case circuit breaker.

Referring to FIG. 1, a top perspective view of a molded case circuit breaker 20 is generally shown. Molded case circuit breaker 20 is generally interconnected within a protected circuit between multiple phases of a power source (not shown) at line end 21 and a load to be protected (not shown) at load end 23. Molded case circuit breaker 20 includes a base 26, a mid cover 24 and a top cover 22 having a toggle handle (operating handle) 44 extending through an opening 28.

Figure 2:
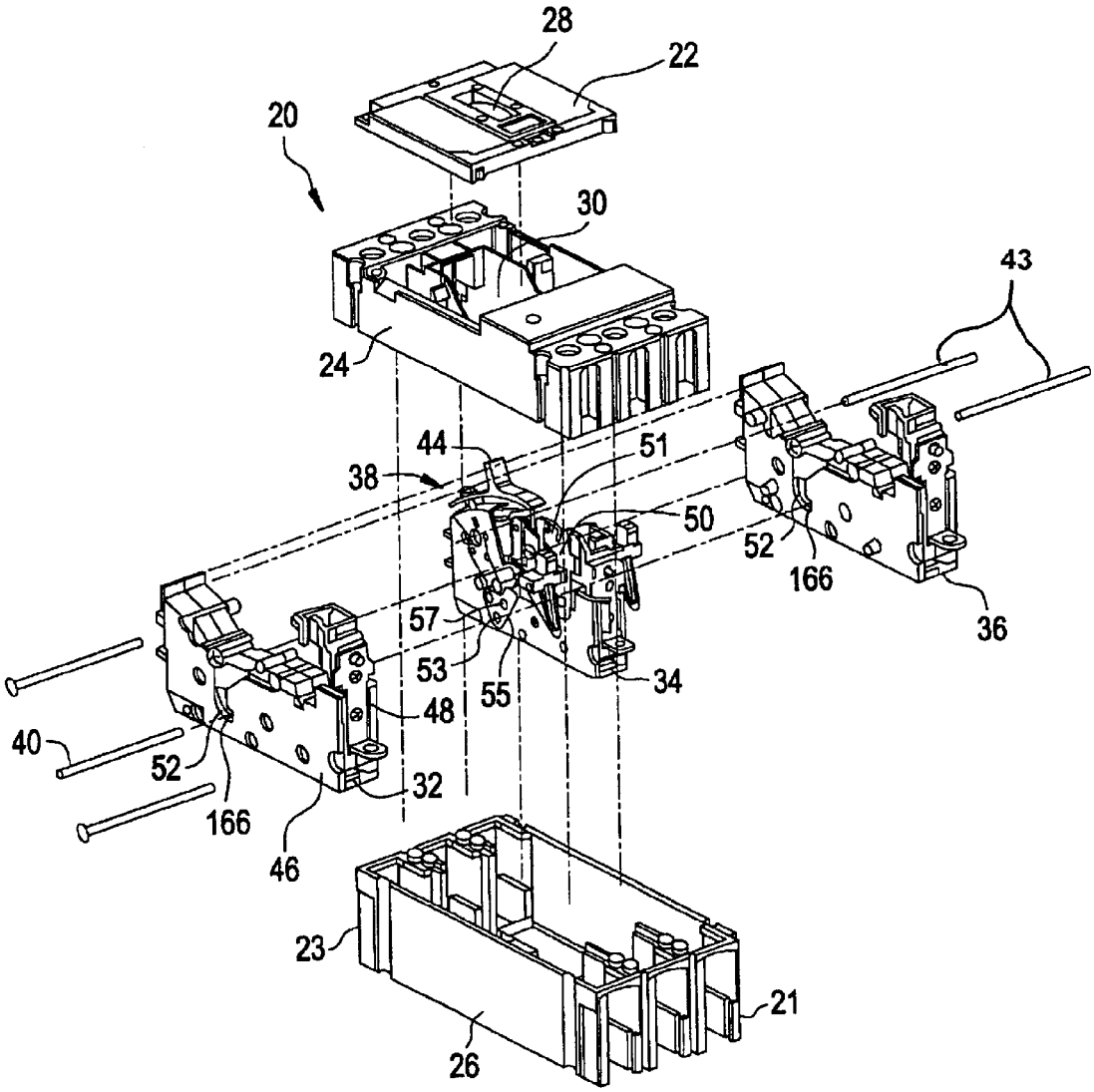
FIG. 2 is an exploded view of the circuit breaker of FIG. 1.

FIG. 2 shows an exploded view of the circuit breaker 20. Disposed within base 26 are a number of cassettes 32, 34, and 36, corresponding to the number of poles (phases of current) in the electrical distribution circuit into which circuit breaker 20 is to be installed. The example shown corresponds to a 3-pole system (i.e., three phases of current), and has three cassettes 32, 34 and 36 disposed within base 26. It is contemplated that the number of cassettes can vary corresponding to the number of phases. Cassettes 32, 34 and 36 are commonly operated by an operating mechanism 38 via a cross pin 40. Cassettes 32, 34, 36 are typically formed of high strength plastic thermoset material and each include opposing sidewalls 46, 48. Sidewalls 46, 48 have an arcuate slot 52 positioned and configured to receive and allow the motion of cross pin 40 by action of operating mechanism 38. Extending from sidewall 46 to sidewall 48 in each of the cassettes 32, 34, and 36 are apertures 41, which accept pins 43. Pins 43 extend through side frames of the operating mechanism 38 and through each cassette 32, 34, and 36 to maintain alignment between the cassettes 32, 34, and 36 and the operating mechanism 38 and to help secure these components together.

Operating mechanism 38 is shown positioned atop and supported by cassette 34, which is generally disposed intermediate to cassettes 32 and 36. It will be appreciated, however, that operating mechanism 38 may be positioned atop and supported by any number of cassettes 32, 34, and 36. Toggle handle 44 of operating mechanism 38 extends through openings 28 and 30 and allows for mating electrical contacts disposed within each of the cassettes to be separated and brought into contact by way of movement of toggle handle 44 between "open" and "closed" positions. Operating mechanism 38 also includes a trip latch 50, which allows a spring latch mechanism 51 in the operating mechanism 38 to be unlatched (tripped) to separate the contacts in each of the cassettes 32, 34 and 36 by way of spring force applied to rotors in each of the cassettes 32, 34, and 36 via cross pin 40. More specifically, cross pin 40 extends through an aperture 53 in a plate 55 and through apertures 166 disposed in rotor assemblies 164 (see FIG. 5) in each of the cassettes 32, 34, and 36. Plate 55 is pivotally mounted to a fixed pivot point 57 and is linked to a spring in the operating mechanism 38. Unlatching the operating mechanism 38 releases the spring to apply a force to pivot the plate 55 about its pivot point 57. As the plate 55 pivots about pivot point 57, the plate 55 drives the rotors via the cross pin 40 to separate the contacts in each of the cassettes. The spring latch mechanism 51 may be reset to a latched position by operation of the toggle handle 44 to a "reset" position. Operating mechanism 38 may operate, for example, as described in U.S. Pat. No. 6,218,919 entitled "Circuit Breaker Latch Mechanism With Decreased Trip Time".

Figure 3:
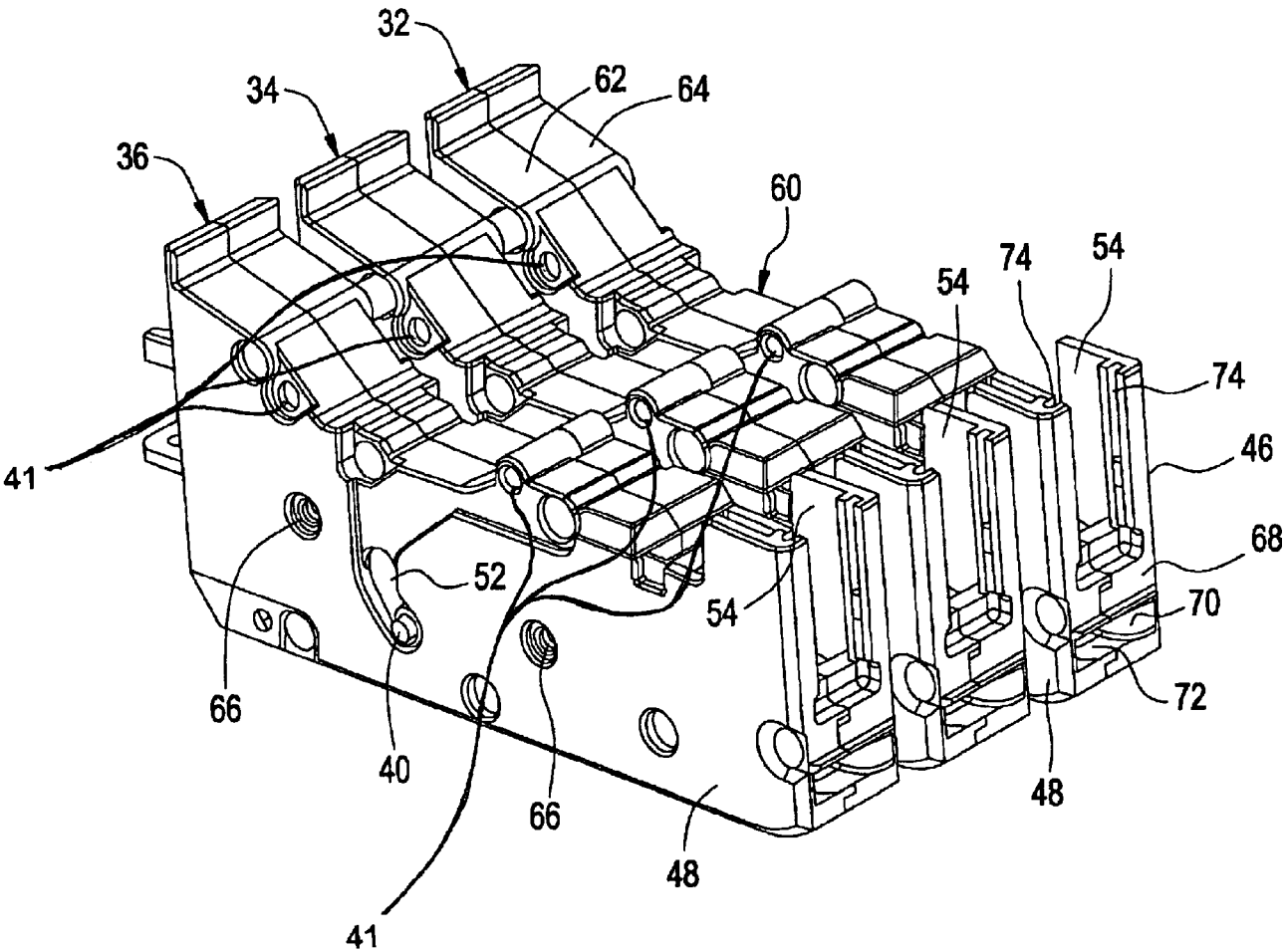
FIG. 3 is a perspective view of circuit breaker cassettes including a compartment for an integrated thermal and magnetic trip unit.

Referring now to FIG. 3, a perspective view of circuit breaker cassettes 32, 34, and 36 including compartments 54 for an integrated thermal and magnetic trip unit are shown. Each of the cassettes 32, 34, 26 include a housing 60 formed by two half-pieces 62, 64 joined by fasteners disposed through seven apertures 66 in the housing 60. A load-side end 68 of the housing 60 includes an outlet port 70 for an arc gas duct 72 formed in the housing 60. Disposed in the housing 60 above the outlet port 70 are a pair of opposing slots 74 that extend along an internal portion of sidewalls 46 and 48.

Figure 4:
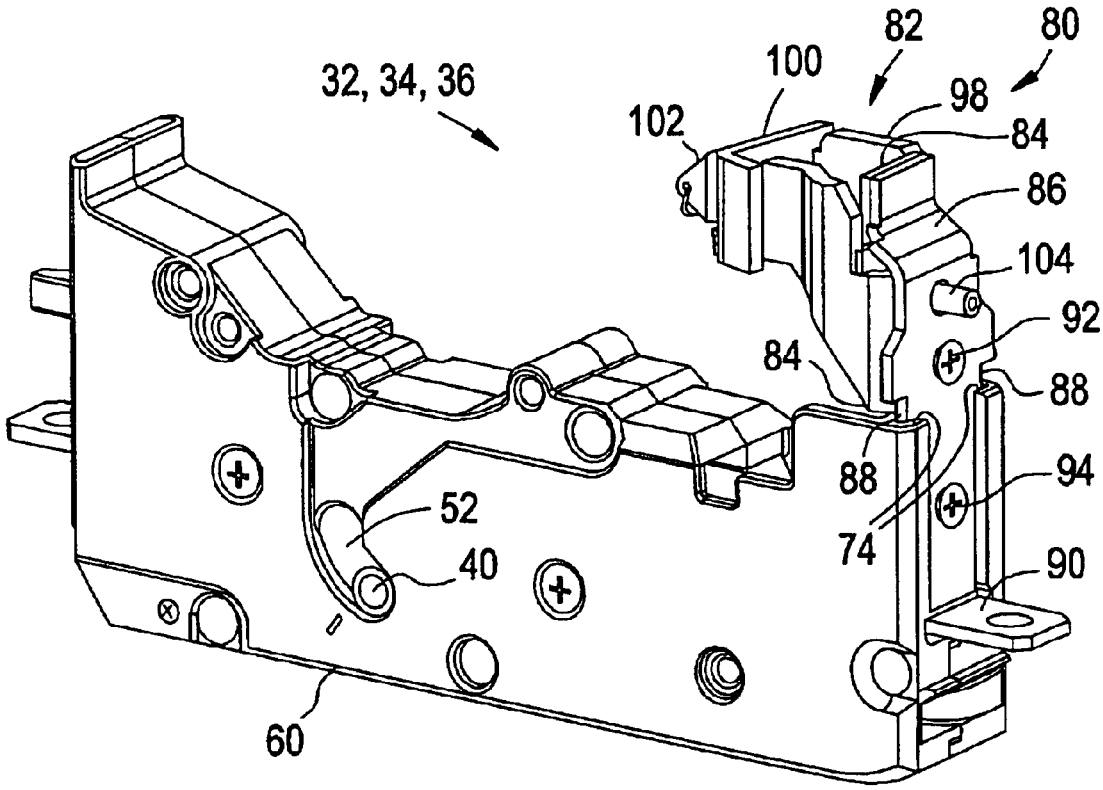
FIG. 4 is a perspective view of one of the circuit breaker cassettes including an integrated thermal and magnetic trip unit.

FIG. 4 is a perspective view of one of the circuit breaker cassettes 32, 34, or 36 supporting an integrated thermal and magnetic trip unit 80. Thermal and magnetic trip unit 80 includes a magnet assembly 82 and a bimetallic element 84 coupled to an end of a load terminal 86. Edges 88 of load terminal 86 are received within the opposing slots 74 formed in the housing 60 of the cassette 32, 34, or 36. A tab 90 extends from load terminal 86 for connection to wiring, a lug, or the like to form an electrical connection with the protected load. Fasteners 92, 94 secure the electromagnet assembly 82 to the load terminal 86, and secure the load terminal 86 to a flux shunt 96 (shown in FIG. 6). Flux shunt 96 is a strip of magnetic material that extends along a length of the load terminal 86, between the load terminal 86 and the bimetallic element 84 to prevent electromagnetic forces developed by current flowing through the load terminal 86 and bimetallic element 84 from deflecting the bimetallic element 84.

Magnet assembly 82 includes a core 98 that extends around the bimetallic element 84, an armature 100 pivotally disposed on a leg 180 of the core 98, and a spring assembly 102 disposed on the armature 100. Spring assembly 102 acts to bias armature 100 away from a leg 188 of the core 98. A threaded setscrew 104 extends through a hole in the load terminal 86 and a threaded hole in the core 98, and comes into contact with the bimetallic element 84. The set screw 104 is used for calibrating the bimetallic element 84. In some cases where a high resistance low amp bimetal is used, an insulator is inserted between the set screw 104 and bimetallic element 84 to prevent a parallel current path through the set screw 104 from damaging to the bimetal.

Figure 5:
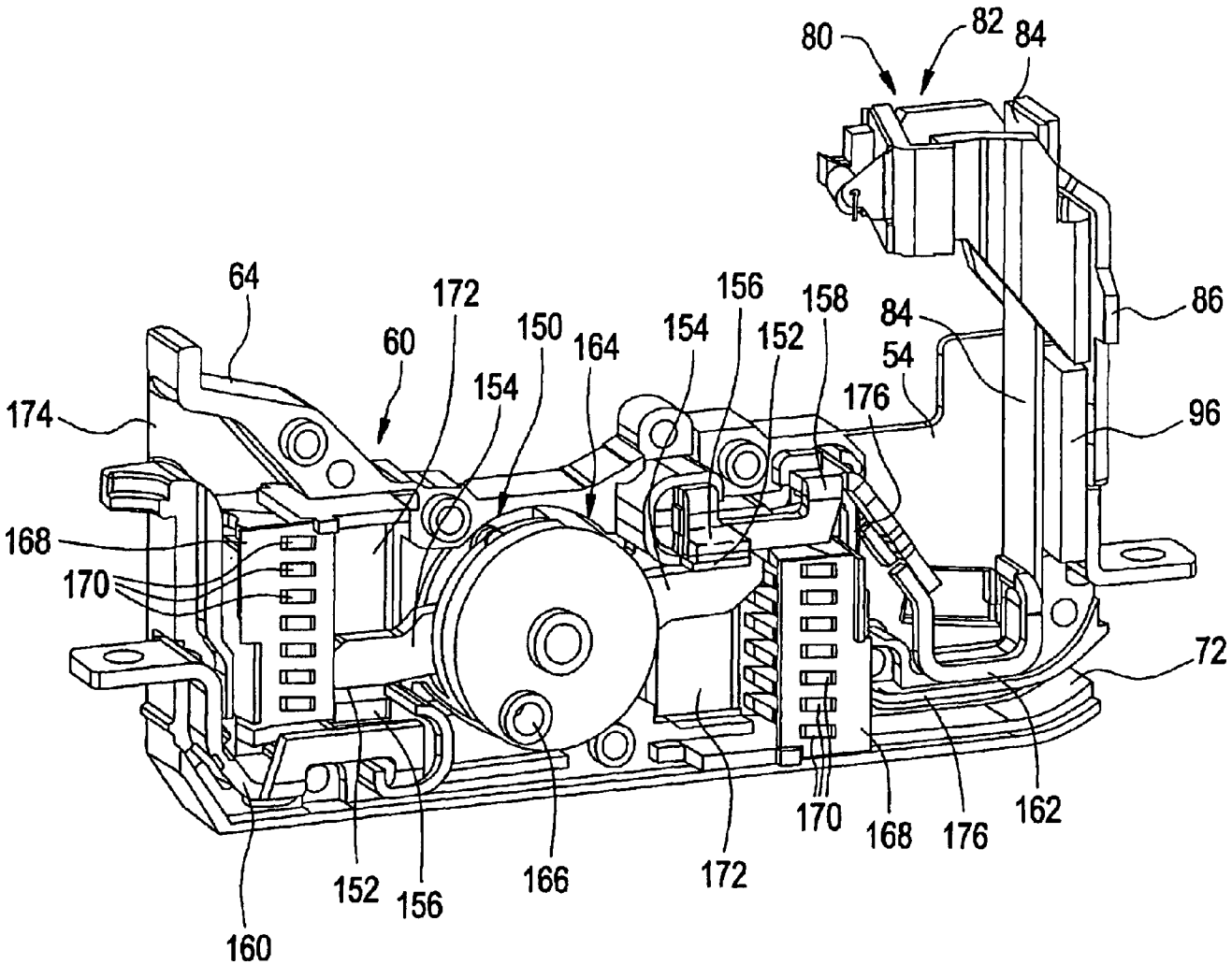
FIG. 5 is a perspective view of a load terminal of the circuit breaker cassette of FIG. 4.

Referring to FIG. 5, the cassette 32, 34, or 36 is shown with one half-piece 62 removed. Supported within cassette 32, 34, or 36 is a rotary contact assembly 150, which includes two mating pairs of electrical contacts, each pair having one contact 152 mounted on a contact arm 154 and another contact 156 mounted on one of a load strap 158 or a line strap/terminal 160. Line-side wiring of the electrical distribution circuit is coupled to line terminal 160, and load-side wiring of the electrical distribution circuit is connected to load terminal 86. Load strap 158 is connected to a flexible braid 162, which is in turn coupled to an end of the bimetallic element 84. When the contacts 152, 156 are in a closed position (i.e., placed in intimate contact), electrical current passes between the line an load sides of the electrical distribution circuit through the line strap/terminal 160, the first pair of electrical contacts 152, 156, the contact arm 154, the second pair of electrical contacts 152, 156, the load strap 158, the flexible braid 162, the bimetallic element 84, and the load terminal 86.

The contact arm 154 is mounted within a rotor assembly 164, which is pivotally supported within the housing 60. A hole 166 in rotor assembly 164 accepts cross pin 40, which transmits the force of the operating mechanism 38 to pivot the rotor assembly 164 about its axis for separating the contacts 152, 156 to interrupt the flow of electrical current to the load terminal 86. The contact arm 154 may also pivot within the rotor assembly 164, thus allowing instantaneous separation of the contacts 152, 156 by the electromagnetic force generated in response to certain overcurrent conditions, such as dead short circuit conditions. The reverse loop shape of the line and load straps 158, 160 directs the electromagnetic force to separate the contacts 152, 156.

As electrical current flows through the bimetallic element 84, a magnetic field is created between the core 98 and the armature 100. The magnetic field pivots armature 100 about leg 180 of the core 98 toward the leg 188 of the core 98. As the armature 100 moves toward the leg 188, it acts on a trip lever (not shown). When the current exceeds a predetermined amount, the magnetic force on the armature 100 overcomes the spring force applied by spring mechanism 102, and the armature 100 pivots to move the trip lever. Also, as current flows through the bimetallic element 84, the bimetallic element 84 heats up and bends due to the different coefficients of expansion in the metals used to form the bimetallic element 84. As the bimetallic element 84 bends due to increased temperature, it comes into contact and moves the trip lever. Movement of the trip lever by either the armature 100 or the bimetallic element 84 unlatches the circuit breaker operating mechanism 38 (FIG. 1), which acts to separate the contacts 152. Operation of the thermal and magnetic trip unit to trip the circuit breaker is described, for example, in U.S. patent application Ser. No. 10/436,619 entitled, "Integrated Thermal And Magnetic Trip Unit", filed concurrently herewith.

As the contacts 152, 156 move apart from each other to interrupt the flow of electrical current, an arc is formed between the contacts 152, 156, and the arc generates ionized gas. An arc arrestor 168 is supported in the housing proximate each pair of contacts 152, 156. The arc arrestor 168 includes a plurality of plates 170 disposed therein, which acts to attract, cool and de-ionize the arc to rapidly extinguish the arc. The gasses generated by the arc pass from a compartment 172 containing the contacts 152, 156, through the arc arrestor 168 and exhaust outside the housing 60 via ducts 72, 174. Duct 72 is formed adjacent to the compartment 54 for the integrated trip unit 80. A wall 176 extends inward from each of the sidewalls 46, 48 to form the duct 72 and to isolate the compartment 54 for the trip unit 80 from the compartment 172 including the contacts 152, 156. Other features that extend inward from each of the sidewalls 46, 48 include supports for the line and load straps 158, 160, support for the rotor assembly 164, and support for the arc arrestors 168.

Figure 6:
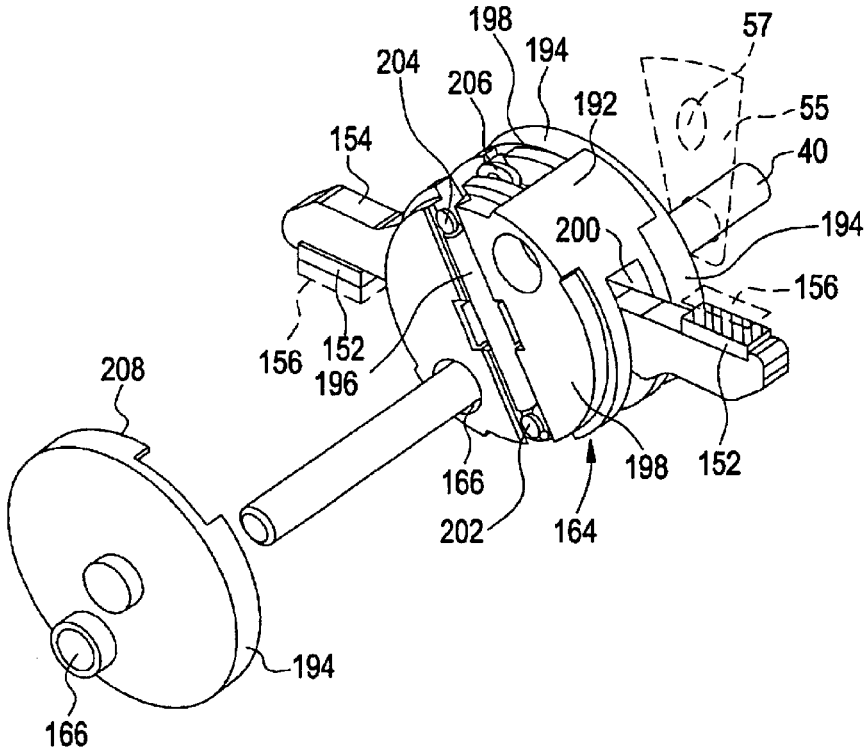
FIG. 6 is a partially exploded view of the rotor assembly and cross pin of the circuit breaker cassette of FIG. 5.

Referring to FIG. 6, rotor assembly 164 is shown with cross pin 40 disposed through the hole 166 in the rotor assembly 164. While only one rotor assembly 164 is shown, it will be appreciated that cross pin 40 extends through the hole 166 in each rotor assembly 164 disposed within each cassette 32, 34, and 36. Rotor assembly 164 includes a rotor 192 having a pair of end caps 194 disposed over end surfaces 198 of the rotor 192, the contact arm 154 pivotally supported by the rotor 192, and one or more springs 196 are disposed on the rotor 192 to bias the contact arm 54 within the rotor 192.

Contact arm 154 extends along a diameter of the rotor assembly 164 midway between the end surfaces 198, and is pivotally secured at the center of the rotor assembly 164. Contact arm 154 is disposed through a slot 200 that extends through the rotor assembly 164 and allows the contact arm 154 to pivot relative to the rotor 192. Springs 196 are disposed in slots formed in the end surfaces 198 and are coupled at one end to the rotor 192 via a pin 202 and at an opposite end to the contact arm 154 via a pin 204 and links 206. The springs 196 bias the contact arm 154 within the rotor 192 such that when the operating mechanism 38 forces the rotor assemblies 164, via plate 55 and cross pin 40, into a contacts closed position, the contacts 152 are biased against the opposing contacts 156. Springs 196 also allow contact arm 154 to pivot within the rotor assembly 164 in response to the electromagnetic force generated between contacts 152 and 156 under certain overcurrent conditions, such as dead short circuit conditions, thus allowing instantaneous separation of the contacts 152, 156 without moving rotor assembly 164.

Each end cap 194 includes a lip 208 extending around its perimeter. The lip 208 retains the end cap 194 on the rotor 192 and covers the top of the spring 196. The end caps 194 extend across the entire end surfaces 198 to cover springs 196. The end caps 194 may be formed from a rigid dielectric material such as, for example, phenolic, melamine, polyester, epoxy, fiberglass, and the like.

Cross pin 40 is formed from a dielectric material. Such materials may include, for example, phenolic, melamine, silicone, epoxy, fiberglass, silicon, Teflon, and the like. In one embodiment, cross pin 40 is formed entirely from a rigid extruded fiberglass epoxy rod material. In another embodiment, cross pin 40 is formed from a steel bar coated with a dielectric material, such as, for example, epoxy, silicon, and Teflon, and the like.

Referring again to FIG. 2, pins 43 may also be formed from a dielectric material. Such materials may include, for example, phenolic, melamine, silicone, epoxy, fiberglass, silicon, Teflon, and the like. In one embodiment, pins 43 are formed entirely from a rigid dielectric polymer material. In another embodiment, pins 43 are formed from a steel bar coated with a dielectric material, such as, for example, epoxy, silicon, and Teflon, and the like.

Figure 7:
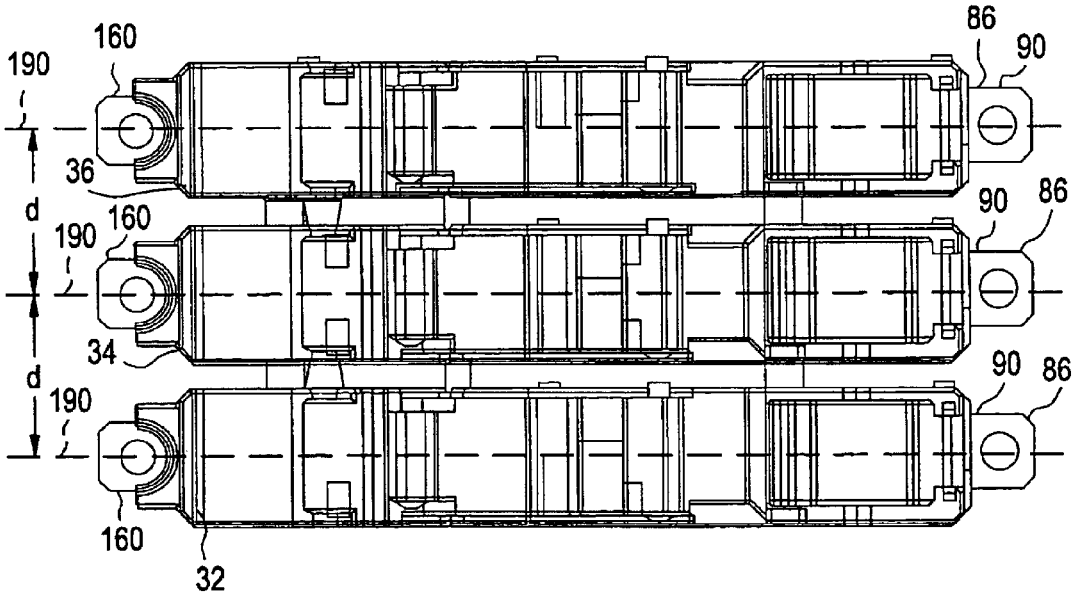
FIG. 7 is a plan view of the circuit breaker cassettes of FIG. 3.

Referring to FIG. 7, a plan view of the cassettes 32, 34, and 36 are shown. As previously noted, each cassette is coupled to a single pole of the multi-pole electrical distribution circuit. Each cassette 32, 34, and 36 has a centerline 190 defined by a line extending from the center of the load strap 160 to the center of the line terminal 86. The spacing between adjacent centerlines 190 is known as "pole spacing", and is indicated as "d".

It has been determined that the use of a dielectric cross pin 40, end caps 194, and dielectric pins 43 provides superior isolation between phases when the circuit breaker 20 is tested for dielectric integrity in accordance with the Underwriters Laboratory (UL) 489 standard. The UL 489 standard requires that the circuit breaker pass a dielectric test after the breaker is subjected to seven short circuit tests in which the circuit breaker is expected to successfully clear the fault at the rated voltage of the circuit breaker. The seven short circuit tests cause the circuit breaker to become highly contaminated, internally, with electrically conductive carbon particles. A dielectric test is then conducted between poles of opposite polarity and ground at a voltage level of 1000 volts plus two times the rating of the breaker applied for one minute. Dielectric testing in accordance with the UL 489 standard has shown that with dielectric cross pin 40, end caps 194, and dielectric pins 43, the pole spacing "d" can be reduced to less than that possible with any known prior art circuit breaker design. Indeed, for circuit breakers rated at 150 amps or less, a pole spacing of about one inch or less can be obtained. Preferably, the pole spacing is no less than about 0.6 inches. A pole spacing of about one inch or less is smaller than that previously obtainable with known prior art circuit breaker designs, which typically require a pole spacing of no less than 1.375 inches in order to meet the dielectric requirements of the UL 489 standard.

For example, a circuit breaker 20 as described herein and having a rated at 600 volts and 100 amps was tested in accordance with the UL 489 standard. In this test, the circuit breaker 20 was subjected to seven short circuit tests of about 10,000 amperes and about 600 volts. A dielectric test was then conducted by applying about 2200 volts for one minute to the primary current path of the center pole (cassette 34), while the primary current paths of adjacent poles (cassettes 32 and 36) were held to ground. The circuit breaker 20 withstood this voltage for a period of at least one minute without breakdown, even when the pole spacing "d" was reduced to about one inch or less.

Circuit breakers 20 of different ratings were also tested and found to meet the dielectric test requirements of the UL 489 standard. For example, circuit breakers rated at 347/600 volts, 480 volts, and 277/480 volts were shown to meet the dielectric requirements of the UL 489 standard with pole spacing at about one inch or less. In sum, the circuit breaker 20 provides for decreased pole spacing while maintaining the dielectric integrity of the circuit breaker.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A molded case, cassette type circuit breaker for a multi-pole electrical distribution circuit, the circuit breaker including:

a number of cassettes equal to the number of poles in the multi-pole electrical distribution circuit; and a pin disposed through each cassette, the pin being formed from a dielectric material.

2. The circuit breaker of claim 1, wherein each cassette includes:

a rotor disposed in the cassette, a pair of electrical contacts disposed in the cassette, a contact arm supported in the cassette by the rotor, the contact arm supporting a contact in the pair of electrical contacts; and wherein the pin is a cross pin extending between each rotor.

3. The circuit breaker of claim 1, wherein the pin further extends through a portion of an operating mechanism, the pin maintaining the operating mechanism and the cassettes in alignment.

4. The circuit breaker of claim 1, wherein the dielectric material is a rigid dielectric material comprising: phenolic, melamine, silicone, epoxy, polyester, fiberglass, or any combination comprising at least one of the foregoing.

5. The circuit breaker of claim 1, wherein the dielectric material includes at least one of: phenolic, melamine, silicone, epoxy, polyester, and fiberglass.

6. The circuit breaker of claim 1, wherein the pin includes a steel bar coated with the dielectric material.

7. The circuit breaker of claim 1, wherein the dielectric material is selected from the group consisting essentially of: epoxy, silicon, and Teflon.

8. The circuit breaker of claim 1, wherein the dielectric material includes at least one of: epoxy, silicon, and Teflon.

9. The circuit breaker of claim 2, wherein each rotor includes a pair of end caps disposed over end surfaces of the rotor.

10. The circuit breaker of claim 1, wherein a pole spacing between adjacent cassettes is about one inch or less.

11. The circuit breaker of claim 10, wherein the pole spacing between adjacent cassettes is greater than or equal to about 0.6 inches.

12. A molded case, cassette type circuit breaker for a multi-pole electrical distribution circuit, the circuit breaker including:

a number of cassettes equal to the number of poles in the multi-pole electrical distribution circuit; and means for reducing pole spacing between adjacent cassettes, thereby allowing the pole spacing to be less than or equal to about one inch.

13. The circuit breaker of claim 12, wherein each cassette includes:

a rotor disposed in the cassette;

a pair of electrical contacts disposed in the cassette;

a contact arm supported in the cassette by the rotor, one of the electrical contacts in the pair of electrical contacts being disposed on the contact arm; and wherein the means for reducing pole spacing between adjacent cassettes includes:

a cross pin extending between each rotor, the cross pin being formed from a dielectric material.

14. The circuit breaker of claim 12, wherein the circuit breaker further includes:

a number of cassettes equal to the number of poles in the multi-pole electrical distribution circuit, each cassette including:

a rotor disposed in the cassette; and wherein the means for reducing pole spacing between adjacent cassettes includes:

a pair of end caps disposed over end surfaces of the rotor.

15. The circuit breaker of claim 12, wherein the means for reducing pole spacing between adjacent cassettes includes:

a pin disposed through each cassette, the pin being formed from a dielectric material.

16. The circuit breaker of claim 14, further comprising:

a contact arm and a contact spring disposed at the rotor, the contact spring disposed to bias the contact arm with respect to the rotor;

wherein the pair of end caps comprise a lip extending at least partially around the perimeter of the end cap, thereby providing coverage at an end of the contact spring.

17. A molded case, cassette type circuit breaker for a multi-pole electrical distribution circuit, the circuit breaker including:

a number of cassettes equal to the number of poles in the multi-pole electrical distribution circuit, and wherein the circuit breaker has a pole spacing between adjacent cassettes of less than or equal to about one inch.

18. The circuit breaker of claim 17, wherein the pole spacing is greater than or equal to about 0.6 inches.

19. The circuit breaker of claim 17, wherein each cassette includes:

a rotor disposed in the cassette;

a pair of electrical contacts disposed in the cassette;

a contact arm supported in the cassette by the rotor, one contact in the pair of electrical contacts being disposed on the contact arm; and wherein the circuit breaker further includes:

a cross pin extending between each rotor, the cross pin being formed from a dielectric material; and an operating mechanism mechanically coupled to the cross pin, the operating mechanism drives the cross pin to rotate each rotor and separate each pair of electrical contacts.

20. The circuit breaker of claim 19, wherein the dielectric material is a rigid dielectric material comprising: phenolic, melamine, silicone, epoxy, polyester, fiberglass, or any combination comprising at least one of the foregoing.

21. The circuit breaker of claim 19, wherein the dielectric material is selected from one or more of: phenolic, melamine, silicone, epoxy, polyester, and fiberglass.

22. The circuit breaker of claim 19, wherein the cross pin includes a steel bar coated with the dielectric material.

23. The circuit breaker of claim 22, wherein the dielectric material is selected from the group consisting essentially of: epoxy, silicon, and Teflon.

24. The circuit breaker of claim 22, wherein the dielectric material includes at least one of: epoxy, silicon, and Teflon.

25. The circuit breaker of claim 19, wherein each rotor includes a pair of end caps disposed over end surfaces of the rotor.

26. The circuit breaker of claim 17, further comprising a pin disposed through each cassette, the pin being formed from a dielectric material.

27. The circuit breaker of claim 17, wherein the circuit breaker is rated at 150 amps or less.

28. The circuit breaker of claim 17, wherein the circuit breaker is rated at one of 600 volts, 347/600 volts, 480 volts, and 277/480 volts.

29. The circuit breaker of claim 17, wherein the circuit breaker meets the dielectric requirements of the UL 489 standard.

30. The circuit breaker of claim 17, wherein the circuit breaker is rated at 150 amps or less and at one of 600 volts, 347/600 volts, 480 volts, and 277/480 volts, and wherein the circuit breaker meets the dielectric requirements of the UL 489 standard.

* * * * *